US005096070A

United States Patent [19]

Jaynes

[11] Patent Number: 5,096,070

[45] Date of Patent: Mar. 17, 1992

[54] SELF LOCKING CLIP STRIP

[76] Inventor: Robert L. Jaynes, 1800 Northwestern Dr., El Paso, Tex. 79912

[21] Appl. No.: 635,236

[22] Filed: Dec. 28, 1990

[51] Int. Cl.[5] ..... A47F 5/00

[52] U.S. Cl. ..... 211/71; 211/113

[58] Field of Search ..... 211/71, 113, 118; 248/205.3, 221.4, 225.1

[56] References Cited

U.S. PATENT DOCUMENTS

| | | | |
|---|---|---|---|
| 4,016,977 | 4/1977 | Krautsack | 248/221.4 X |
| 4,461,387 | 7/1984 | Belokin | 211/71 |
| 4,572,380 | 2/1986 | Langwell | 248/221.4 X |
| 4,573,590 | 3/1986 | Ellis | 211/118 X |
| 4,718,627 | 1/1988 | Fast et al. | 211/113 X |
| 4,817,805 | 4/1989 | Rodriquez | 211/71 |
| 4,911,392 | 3/1990 | Fast | 211/113 X |
| 4,938,368 | 7/1990 | Sharman | 211/71 X |

*Primary Examiner*—Robert W. Gibson, Jr.

*Attorney, Agent, or Firm*—Fleit, Jacobson, Cohn, Price, Holman & Stern

[57] ABSTRACT

A self locking clip strip includes a protrusion for engaging a hole in a bag of food items to be supported. Adjacent the protrusion is a pair of flaps which extend over the top of the bag and secure the upper edge of the bag to the backing sheet. In the preferred embodiment, a plurality of protrusions is provided in a line such that a plurality of bags may be supported in a vertical display.

10 Claims, 2 Drawing Sheets

SELF LOCKING CLIP STRIP

TECHNICAL FIELD

This invention relates to articles used for display of grocery items. In particular, the invention is an improvement of an article used to display small bags of food and known generally as a clip strip.

BACKGROUND ART

It is known to display small bags of food, such as bags of potato chips, by providing an elongate strip having a linear array of clips thereon. Each of the clips is designed to engage the upper edge of one of the bags to hold the bag to the strip. The strip can be attached to any of a variety of objects, such as a store case displaying related food products.

The prior clip strips are generally made of metal and are, thus, relatively expensive. The strips are also expensive to use because the bags which have been removed by customers must be manually replaced by store personnel. Prior clip strips, moreover, do not adequately secure the bags to the strip which results in loss to the store when the bags fall to the floor and are damaged.

SUMMARY OF THE INVENTION

In accordance with the invention, a unique clip strip comprises a plurality of protrusions which engage holes in the bags to be supported. Flaps are placed on opposite sides of each protrusion for engaging the upper edge of a bag, the engagement of the bag between the protrusion and the flaps securing the bags to the strip.

The flaps are formed in an elongate backing sheet, and the protrusions may either be integral with this sheet or formed in a separate strap attached to the backing sheet. When the strap is separate from the backing sheet, it may be placed on either the front or the rear of the sheet. When the strap is placed on the rear of the sheet, holes are provided on the backing sheet to allow the protrusions to extend therethrough.

The strap may be secured to the backing sheet by glue or any other means known in the art.

The strap and the backing sheet are designed to be held to a display case together, the strap supporting the majority of the weight of the bags.

DETAILED DESCRIPTION OF THE INVENTION

Figure 1:
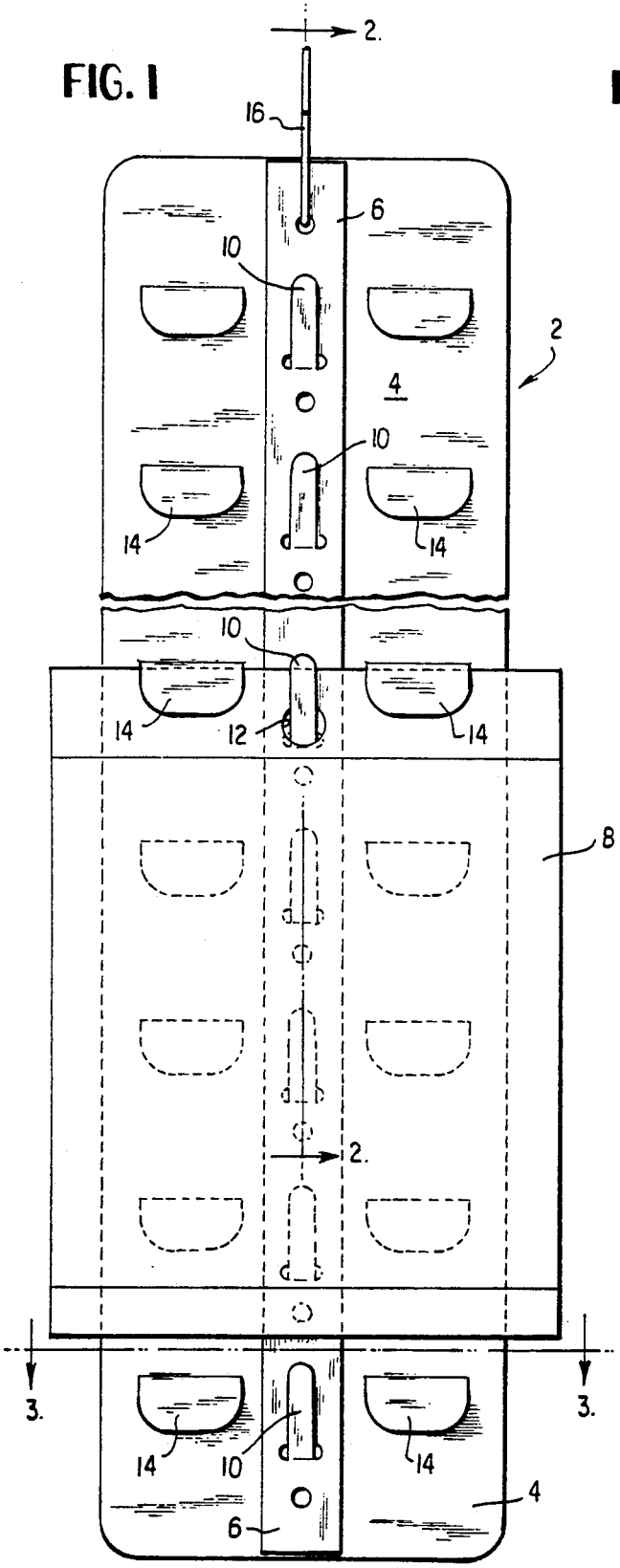
FIG. 1 is a front view of a first embodiment of a self locking strip in accordance with the invention.
Figure 2:
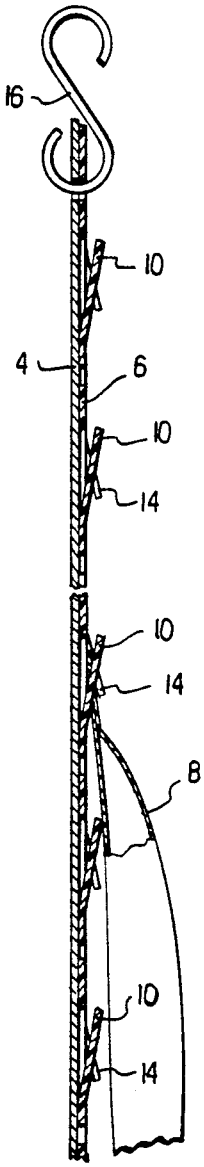
FIG. 2 is a cross section taken along line 2—2 of FIG. 1.
Figure 3:
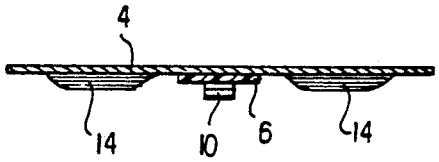
FIG. 3 is a cross section taken along line 3—3 of FIG. 1.

With reference to FIG. 1, a self locking strip 2 in accordance with the invention comprises a backing sheet 4 and a strap 6. While the backing sheet and the strap are shown separate in the embodiments shown in the figures, it is within the contemplation of the invention that the two be integral. The strip is designed to support a plurality of bags containing food products such as the single bag 8 which is shown for illustration of the operation of the invention.

The strip 2 includes a plurality of protrusions 10 each of which is designed to pass through a hole 12 in a bag and to support the major part of the weight of the bag and its contents. Laterally adjacent each of the protrusions 10 is a pair of flaps 14 each of which extends over a respective part of the upper edge of the bag. The flaps cooperate with the centrally located protrusion to secure the bag to the strip.

In the embodiment shown in figures through 3, the protrusions 10 are formed on strap 6 which is attached to the front of the backing sheet by adhesive, or otherwise. The protrusions 10 are integrally molded of plastic with the strap and are relatively inflexible to be capable of supporting the weight of a bag and its contents without bending. The flaps are formed in the backing sheet, which is preferably of cardboard to reduce cost and to provide flexibility to the flaps. Thus, a bag may be removed by lifting the bag upward to disengage it from a protrusion and at the same time bending the flaps away from the surface of the backing sheet.

It will be appreciated that the protrusion is slightly lower than the locations of attachment of the flaps to the backing sheet, this distance being determined by the amount by which the hole is displaced from the upper edge of the bag.

This construction has been found to be very secure. The bags do not fall from the strip and are retained to the strip even if the strip is inadvertently inverted.

The strip may be held to a display case or the like by any of a variety of ways. One preferred way is by the use of a hook 16 which passes through aligned holes in the backing sheet and in the strap.

Figure 4:
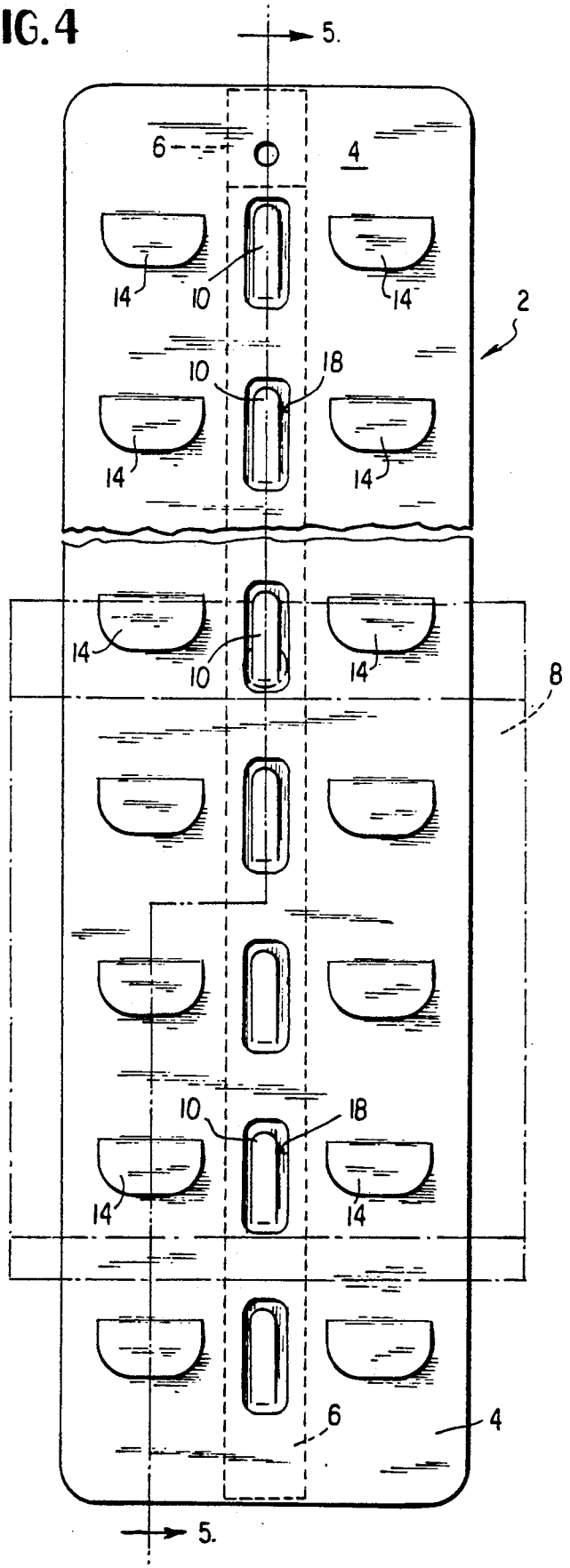
FIG. 4 is a front view of a second embodiment of a self locking strip in accordance with the invention.
Figure 5:
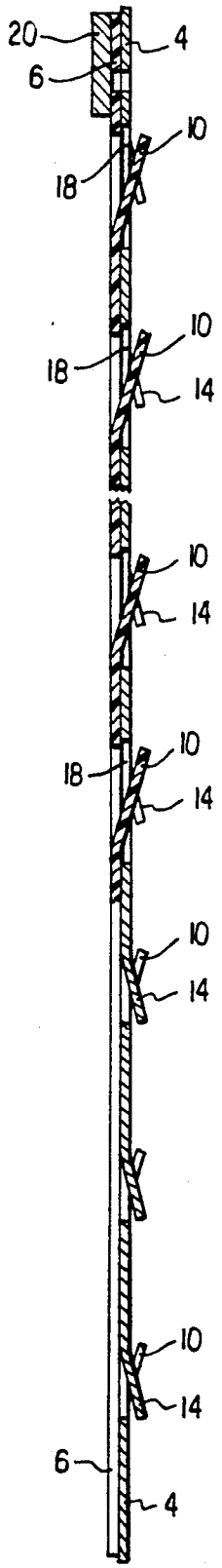
FIG. 5 is a cross section taken along line 5—5 of FIG. 4.

FIGS. 4 and 5 illustrate another embodiment. According to this embodiment, the strap 6 is placed on the rear of the backing sheet 4, and the protrusions 10 extend through holes 18 in the backing sheet 4. Otherwise, the operation of the protrusions and the flaps is the same as described above with respect to the first embodiment.

The embodiment of FIGS. 4 and 5 lends itself more easily to the use of an adhesive element for supporting the strip. An adhesive tab is shown at 20 and may include an element which includes a removable part, such as a Velcro tab to permit easy removal of a used strip and attachment of a new one.

Modifications within the scope of the appended claims will be apparent to those of skill in the art.

I claim:

1. Apparatus for removably supporting a bag comprising a strap attached to a backing sheet, means in said strap for supporting the weight of said bag and means for holding a top edge of said bag, at least one of said means for supporting and said means for holding being flexible to permit removal of said bag, wherein said means for supporting comprises a protrusion for extending through a hole in said bag and said means for holding comprises first and second flaps positioned in said backing sheet on respective sides of and spaced away from said protrusion.

2. Apparatus according to claim 1 wherein said first and second flaps are pivotally attached to a backing sheet for securing respective portions of said upper edge of said bag between said flaps and said backing sheet.

3. Apparatus according to claim 2 wherein said flaps extend from said backing sheet in a downward direction and said protrusion extends in an upward direction.

4. Apparatus according to claim 3 comprising a plurality of said protrusions and a like plurality of said first and second flaps, each of said first and second flaps being associated with a respective said protrusion.

5. Apparatus according to claim 4 wherein said plurality of protrusions are arranged in a line.

6. Apparatus for removably supporting a bag comprising means for supporting the weight of said bag and means for holding a top edge of said bag, at least one of said means for supporting and said means for holding being flexible to permit removal of said bag, wherein said means for supporting comprises a protrusion for extending through a hole in said bag and said means for holding comprises first and second flaps positioned on respective sides of said protrusion, wherein said first and second flaps are pivotally attached to a backing sheet for securing respective portions of said upper edge of said bag between said flaps and said backing sheet and said flaps extend from said backing sheet in a downward direction and said protrusion extends in an upward direction, wherein said apparatus comprises a plurality of said protrusions and a like plurality of said first and second flaps, each of said first and second flaps being associated with a respective said protrusion, and wherein said protrusions are formed in a strap attached to said backing sheet.

7. Apparatus according to claim 6 wherein said backing sheet has a plurality of holes and a respective one of said protrusions passes through a respective said hole.

8. Apparatus according to claim 6 wherein said strap is molded plastic and said backing sheet is cardboard.

9. Apparatus according to claim 6 further comprising means for supporting said backing sheet and said strap.

10. Apparatus according to claim 9 wherein said means for supporting is attached only to said strap, and said strap is attached to said backing sheet.

* * * * *